US005228217A

United States Patent [19]

Dabuzhsky et al.

[11] Patent Number: 5,228,217

[45] Date of Patent: Jul. 20, 1993

[54] METHOD AND A SHOE SOLE CONSTRUCTION FOR TRANSFERRING STRESSES FROM GROUND TO FOOT

[76] Inventors: Leonid Y. Dabuzhsky, 86 High Rock Ter., Newton, Mass. 02167; Moisey M. Lerner, 75 Rolling La., Needham, Mass. 02192

[21] Appl. No.: 692,285

[22] Filed: Apr. 26, 1991

Related U.S. Application Data

[63] Continuation of Ser. No. 509,418, Apr. 12, 1990, Pat. No. 5,010,662, which is a continuation of Ser. No. 138,957, Dec. 29, 1987, abandoned, which is a continuation-in-part of Ser. No. 106,152, Oct. 8, 1987, abandoned.

[51] Int. Cl.[5] ..... A43B 13/20

[52] U.S. Cl. ..... 36/28; 36/29; 36/30 R

[58] Field of Search ..... 36/28, 29, 35 R, 35 B, 36/37, 25 R

[56] References Cited

U.S. PATENT DOCUMENTS

| | | | |
|---|---|---|---|
| 1,089,036 | 3/1914 | Bartels . | |
| 1,771,746 | 7/1930 | Clifford . | |
| 2,077,121 | 4/1937 | Lovell | 12/142 |
| 2,677,906 | 5/1954 | Reed | 36/71 |
| 2,740,209 | 4/1956 | Shultz | 36/77 |
| 2,756,519 | 7/1956 | Hill | 36/77 |
| 3,270,358 | 9/1966 | Milner | 12/142 |
| 4,005,531 | 2/1977 | Weintraub et al. | 36/28 |
| 4,008,530 | 2/1977 | Gager | 36/28 |
| 4,100,686 | 7/1978 | Sgarlato et al. | 36/29 |
| 4,115,934 | 9/1978 | Hall | 36/44 |
| 4,129,951 | 12/1978 | Petrosky | 36/29 |
| 4,219,945 | 9/1980 | Rudy | 36/29 |
| 4,223,457 | 9/1980 | Borgeas | 36/35 B |
| 4,227,320 | 10/1980 | Borgeas | 36/88 |
| 4,229,889 | 10/1980 | Petrosky | 36/28 |
| 4,458,430 | 7/1984 | Peterson | 36/28 |
| 4,670,995 | 6/1987 | Huang | 36/29 |
| 4,676,009 | 6/1987 | Davis et al. | 36/7.8 |
| 4,768,295 | 9/1988 | Ito | 36/28 |
| 4,799,319 | 1/1989 | Zellweger | 36/2.6 |
| 4,864,737 | 9/1989 | Marrello | 36/29 |
| 5,010,662 | 4/1991 | Dabuzhsky et al. | 36/28 |

FOREIGN PATENT DOCUMENTS

| | | | |
|---|---|---|---|
| 2460034 | 6/1976 | Fed. Rep. of Germany | 36/29 |
| 1007060 | 4/1952 | France | 16/4 |
| 1011213 | 6/1952 | France | 16/4 |
| 2508778 | 1/1983 | France . | |
| WO89/11047 | 11/1989 | PCT Int'l Appl. . | |
| 792034 | 3/1958 | United Kingdom . | |

*Primary Examiner*—Steven N. Meyers
*Attorney, Agent, or Firm*—Weingarten, Schurgin, Gagnebin & Hayes

[57] ABSTRACT

The sole comprises a case in which a liquid-containing chamber is connected to a chamber containing sponge-like material. Pressure on the weight-bearing portion of the foot is redistributed isostatically by the liquid-containing chamber. The pressure created in the liquid-containing chamber is applied against chamber having the air-containing material. The compressed air-material chamber stores energy when the foot pushes against the ground and releases it, spring-like, into the liquid chamber when the foot moves from the ground. The sole also provides for use of unequal ceiling and floor surface areas in the liquid chamber for decreased or increased forces felt on the foot.

5 Claims, 2 Drawing Sheets

FIG. 1A
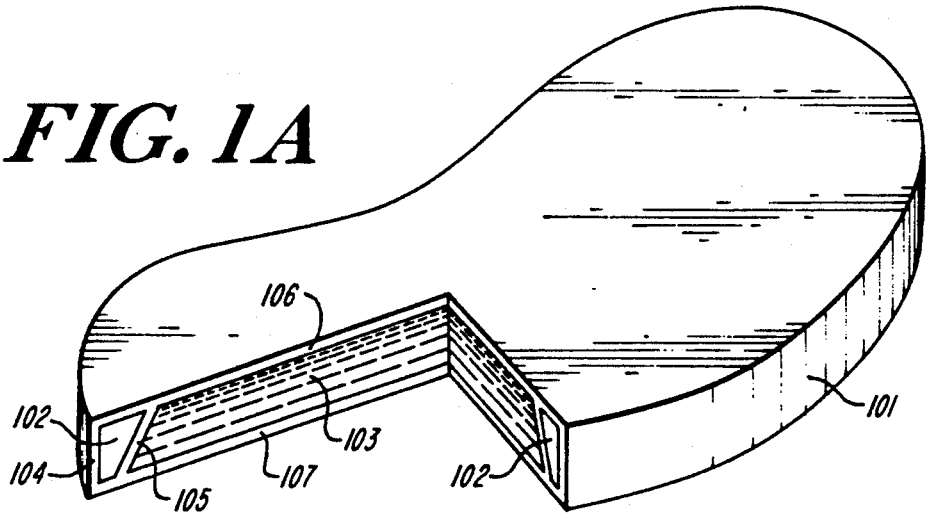
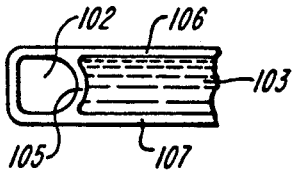
FIG. 1B
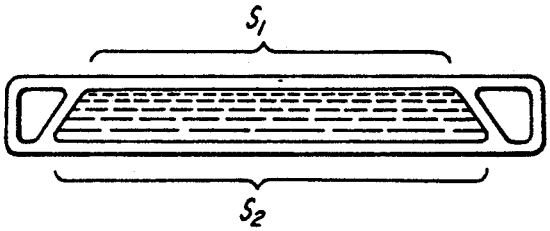
FIG. 1E
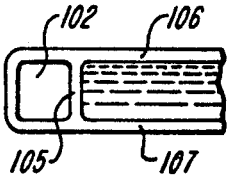
FIG. 1C
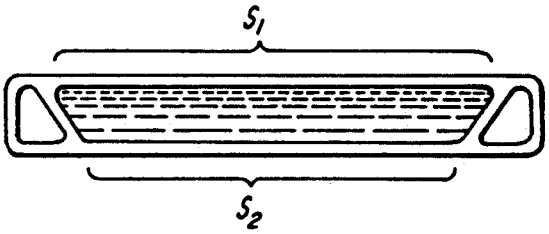
FIG. 1F
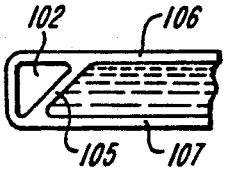
FIG. 1D

METHOD AND A SHOE SOLE CONSTRUCTION FOR TRANSFERRING STRESSES FROM GROUND TO FOOT

This application is a continuation of allowed co-pending prior U.S. utility patent application Ser. No. 509,418, filed Apr. 12, 1990, now U.S. Pat. No. 5,010,662, entitled A Sole For Reactive Distribution of Stress on the Foot; which is a continuation of U.S. utility patent application Ser. No. 138,957, filed Dec. 29, 1987, now abandoned; which is a continuation-in-part of U.S. utility patent Ser. No. 106,152, filed Oct. 8, 1987, now abandoned.

FIELD OF THE INVENTION

The invention relates to a sole for cushioning the foot, and more particularly to a sole for redistributing pressure on the weight bearing surface of the foot.

BACKGROUND OF THE INVENTION

Pneumatic and liquid-containing footwear and soles have been provided in prior art that pertain to the absorption or transfer of pressure from various surfaces of the sole.

The encapsulation of air in a chamber allows the sole to provide a cushioning effect to the foot. The encapsulation of liquid in a chamber similarly provides a cushioning effect to the foot without the springing quality of air due to the liquids relative resistance to compression at pressures typically exerted by a human foot on the sole. Soles containing air and/or liquid (including gels and similar materials) are provided by U.S. Pat. Nos. 4,008,530; 4,219,945; 4,223,457; 4,277,320; 4,458,430; 4,670,995; 4,676,009; and 4,799,319. None of these employ the compressive qualities of encapsulated air in conjunction with the pressure-distributive qualities of encapsulated liquid.

U.S. Pat. No. 4,768,295 discloses a sole comprised of a sole member which surrounds and contains a cushioning plate having an internal pair of sheets adhered together at spacings to form a plurality of gel-filled chambers. Air chambers are formed between the filled chambers and surrounding sole plate. The sole plate, comprised of solid material, does not allow pressures on the cushioning member to be redistributed evenly over the weight bearing surface of the foot in conjunction with the cushioning member.

U.S. Pat. No. 4,008,530 teaches a sole having a shaped inflatable upper section mounted on a shaped lower inflatable section. Each section is fitted with valves and may be filled with air or liquid or a mixture of both. While capable of exploiting the respective benefits of liquid and air, the structure of the sole is susceptible to torsional instability and canting. There is the potential for collapse between portions of the ceilings and floors of the sections, especially when the heel or ball area of the feet strike the ground with abnormal force.

U.S. Pat. No. 4,864,737 discloses a sole having a sheet formed to provide a grid of spaced peaks connected to the roof and floor within a compartment. The sheet forms two chambers of interconnected pockets: The upper ones containing liquid, the lower ones containing air. The sheet, however, does not provide independent structural support under pressure and renders the sole vulnerable to torsional instability, canting, and internal tearing and rupture. Nor does the construction of the sole provide for control over the extent to which the properties of air and liquid are exploited; presumably, the air and liquid must be used in equal volumes.

In view of the foregoing difficulties and limitations, a sole is needed for transferring pressure from the weight-bearing portions of the foot and redistributing it evenly without introducing torsional instability, and for providing a structure wherein the respective properties of encapsulated air and encapsulated liquid are cooperatively joined in a reactive manner.

SUMMARY OF THE INVENTION

In surmounting the difficulties and limitations described above, the present invention provides a sole for redistributing pressure on the plantar portion of the foot. An exemplary embodiment of the invention provides a sole having a case which is positioned between the plantar surface of the sole and the ground. The case has top and bottom portions connected to each other by inner and outer walls which contribute to the structural integrity of the case.

The case contains at least two internal chambers, one filled with liquid, the other with air, sandwiched side-by-side between the top and bottom portions and within the outer walls of the case. The liquid chamber is separated from the air chamber by an inner wall, which connects top and bottom portions of the case to each other. The inner wall provides structural integrity to the case by contributing to the prevention of canting or collapse of the top portion against the bottom portion. The inner wall must also be capable of elastically deforming under the pressure of the liquid against it when the wearer steps on the sole. The liquid chamber, which is positioned below the plantar surface of the foot and therefore beneath the heel and metatarsal bones, is surrounded by the air chamber. The liquid chamber redistributes pressure evenly across the plantar portion of the foot. Pressure in the liquid chamber pushes the resilient inner wall into the air chamber. The air compresses as the inner walls deform and energy is stored by the compressed air until the foot moves upward from the ground.

Sponge-like material or other air-containing media may be used in or in place of the air-containing chamber in a further exemplary embodiment of the invention. The air-containing media may further have a sponge-like, resilient and compressible material which does not absorb liquid.

In a further embodiment of the invention, the liquid chamber has a ceiling with surface area $S_1$ and a floor with surface area $S_2$. Ideally, the surface area $S_1$ should be no less than the surface area of the foot against which it presses. Since pressure (P) within the liquid-containing chamber is distributed evenly inside the liquid over the internal surface of the chamber, the ratio between the force $F_1$ at surface area $S_1$ must equal the ratio of force $F_2$ at surface area $S_2$, or in other words: $P=F_1/S_1=F_2/S_2$. Thus, when $S_1$ is less than $S_2$, there is a force reducing effect felt on the plantar surface of the foot. This effect is useful where generated forces greatly exceed those generated during walking, such as in parachute jumping. Conversely, when $S_1$ is greater than $S_2$, the sole can provide a force magnification effect which is experienced as a heightened springiness sensation over the entire plantar surface of the foot. For example, in high heel or ballet shoes which have a surface area $S_1$ substantially greater than $S_2$, a springiness sensation may be felt at $S_1$.

The resilient internal wall and controlled surface area of the liquid chamber contribute to a sole construction readily adaptable to various shoe wearers and uses. Thus, a shoe manufacturer may design a sole that is specifically suited for wearers within a particular size and weight range and for particular activities, e.g., walking, running, playing tennis on an asphalt court. The design of the sole will facilitate ease, economy, and adaptability in design and manufacture of shoes and soles.

Through its ability to redistribute pressure on the sole without sacrificing structural stability, the present invention will decrease the incidence of injury to feet, ankles, knees, legs, and hips during walking, running, or jumping. The construction of the sole may also eliminate surgery for biomechanical foot abnormalities and prevent pressure-related problems in neuropathic feet. The cushioning properties of the sole also provide for reduction of force from the contact of the heel to the ground, an obvious benefit to patients having hip and knee replacement operations.

BRIEF DESCRIPTION OF THE DRAWINGS

A more thorough understanding of the present invention and the attendant advantages and features thereof will be more readily understood by reference to the following detailed description, when considered in conjunction with the accompanying drawings, wherein:

FIG. 1A is a perspective view of the sole according to the present invention;

FIG. 1BA is a partial cross-section view of the sole having a convex wall between the air and liquid chambers;

FIG. 1C is a partial cross-section view of the sole having a straight wall between the air and liquid chambers;

FIG. 1D is a partial cross-section view of the sole having an angled inner wall between the air and liquid chambers;

FIG. 1E is a full cross-section view of the sole in which the ceiling of the liquid chamber has a surface area $S_1$ less than surface area $S_2$ of the floor of said chamber;

FIG. 1F is a full cross-section view of the sole in which the ceiling of the liquid chamber has a surface area $S_1$ greater than surface area $S_2$ of the floor of said chamber.

DETAILED DESCRIPTION OF THE INVENTION

Figure 2:
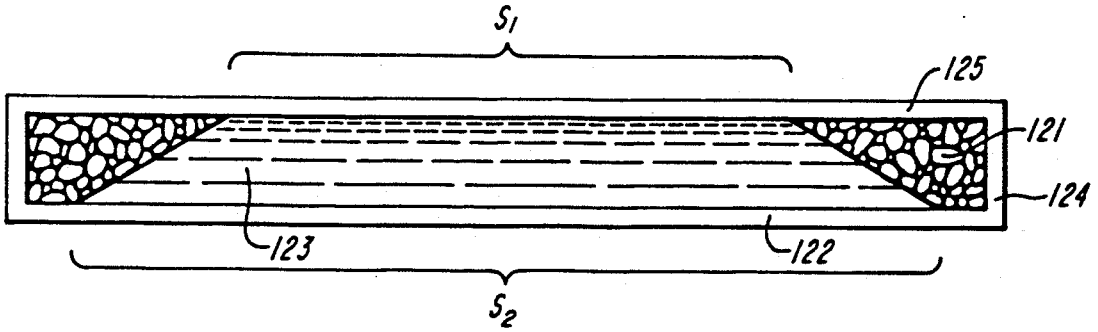
FIG. 2 is a full cross-section view of an alternative embodiment of the sole of FIG. 10E wherein a liquid containing chamber is surrounded by a sponge-like material, and in which the ceiling of the liquid chamber has a surface area $S_1$ less than the surface area $S_2$ of the floor of the chamber.

In FIGS. 1A through 1F, there is shown various embodiments of a sole having a case 101 comprised of a top portion 106 for disposition of the sole against the plantar surface of a foot, a bottom portion 107 for disposition of the sole against the ground, an outer wall 104, and an inner wall 105 which defines two chambers 102/103 between the top and bottom portions 106/107 and within the outer wall 104. The inner wall 105 surrounds and defines the inner chamber 103, which contains a liquid, and separates it from the surrounding outer chamber 102, which contains air. The inner wall 105 is comprised of a resilient material. The internal wall 105 connects the top portion 106 to the bottom portion 107, lending structural integrity to the sole when the foot exerts downward force. However, the resilient wall 105 is sufficiently elastic so as to deform into the air chamber 102 due to pressure in the liquid chamber 103. The thickness and resilience of the material of the wall 105 may be predetermined in accordance with the size of the sole, the intended wearer, or the intended activity or sport for which the sole is used. The chamber 102 which is defined by the walls 104 and 105 has the form of a channel and said channel is filled with air. The air chamber 102 can also be created by a tube attached to wall 104. The liquid chamber 103 is formed by the roof 106 of said chamber, by the floor 107, and the internal wall 105. Said chamber 103 is filled up by liquid. The purpose of this construction is to provide a smoother and substantially controlled absorption and transfer or redistribution of kinetic energy when stresses applied to the roof and ground portions of the sole exceed the ordinary walking stresses. These excessive stresses are generated during running and/or jumping in the phases of toe-off and landing. The liquid contained in the inner chamber 103 redistributes pressure over the weight bearing surface of the foot positioned over the chamber 103. The energy generated by contact with the ground and exerted upon the inner liquid-containing chamber 103 is in turn applied to the wall 105, causing it to deform and absorb a portion of the generated energy, which compresses the air chamber 102 by means of the resilient inner wall 105. The energy stored in this manner generates a compressive springing force as the foot moves away from the ground, thereby returning some of the initial kinetic energy stored as potential energy. The compressed air chamber 102 and liquid chamber 103 acting in conjunction with the air chamber 102 by means of the resilient internal wall 105 transfers pressures distributed along the whole weight bearing surface of the foot, creating a feeling of a particular lightness and comfort during the process of movement. The amount of kinetic energy absorbed via deformation of the wall 105 and the degree of said energy dissipation into heat depends on the thickness of the wall material and its resilience. Said deformation is limited by the essentially nonstretchable external wall 104 of the sole, which prevents the sole from collapsing. Said collapsing would happen if a substantial portion of the liquid filled chamber 103 is pressed into the deforming wall 105 at excessively high pressure levels, generated during jumping, for example, and this deformation is not stopped by the outer wall 104, which should be made of nonstretchable material, therefore causing the ceiling of the roof 106 of the chamber 103 to collapse to the floor of the chamber 107.

The channel 102, which is filled with air, may have a round (see FIG. 1B), rectangular (see FIG. 1C) or any other cross-sectional configuration. However, said channel should predominantly have a triangular (see FIG. 1D) or trapezoidal cross-section configuration with the top of the triangle, or the shorter base of the trapezoid being located at the bottom of the chamber (see FIG. 1D and 1E). The roof 106 of the chamber in FIG. 1E, which is disposed against the plantar surface of the foot, has a surface area $S_1$, essentially smaller than the surface area $S_2$ which transfers the pressure from the liquid to the ground.

A force reducing or magnifying effect may occur because of the difference between $S_1$ and $S_2$. Since pressure (P) is evenly distributed by the liquid against the surfaces of the liquid-containing chamber and is equal to the ratio of force (F) per given surface area (S) therein, and therefore $P=F_1/S_2=F_2/S_2$, then $F_1$ at the ceiling 106, for example, is increased in proportion to the increase in $S_1$. Thus, a force magnifying effect on the foot occurs (felt as additional springiness) where $S_1>S_2$ as shown in FIG. 1F, or decreased where $S_1<S_2$ as shown in FIG. 1E.

The air chamber 102 in the above-described embodiment of this invention is located along the outer wall 104 inside the sole. According to this invention this chamber which is able to compress in volume due to the inward deformation of the resilient internal wall 105 at a predetermined pressure may be located also inside the chamber filled with liquid. Moreover, there may be not a single one but several of these chambers inside the chamber.

FIG. 2 shows a further embodiment of the invention wherein a sponge-like resilient but compressible material 121, or in other words an air-containing media, is used in or instead of the air-filled chamber to absorb and, to a certain degree, dissipate kinetic energy generated when the sole 122 contacts the ground. The chamber 123 is filled with liquid or similar material. The walls 124 and 125 of the sole are preferably comprised of material which resists without significant deformation pressures which are transferred to the walls by the layer of sponge-like material 121. A wall may be further used between the sponge-like material 121 and chamber 123 depending on the density of the material 121. The cross-section of said sponge-like material should preferably have a configuration in which it becomes thinner towards the bottom 122 of the sole, so as to increase the surface area $S_2$ of the out sole, which transfers stress to the liquid.

Any liquid can be used to fill the inner chamber 103/123 of the sole, or cells or bladders containing materials providing substitutes for the continuous liquid. A liquid with lower than water density can be chosen from spirits (alcohols), such as simple alcohols with a single hydroxyl group (methyl-, ethyl-, etc. alcohols), or oils like linseed oil, cotton seed oil, etc. The liquid, of course, may also have a density equal to or greater than that of water.

A liquid having density higher than that of water can be chosen from alcohols having more than one hydroxyl group (such as glycerine), glycols (such as ethyleneglycol, etc.). Water in combination with ethyleneglycol or alcohols can also be used in the proportion to secure antifreezing of the liquid in the temperature range normal for the user or a shoe with the sole described in this invention.

What is claimed is:

1. A sole comprising:

a case for placement between the foot and ground having a top portion for location of said case against the plantar portion of the foot;

a bottom portion spaced apart from said top portion for location of said case against the ground;

an outer wall for connecting said top portion to said bottom portion;

said case further enclosing at least one chamber containing liquid;

an air-containing resilient material located between said top and bottom portions and between said outer wall and said at least one chamber containing liquid; and said at least one chamber containing liquid defined by a ceiling of surface area $S_1$ and a floor of surface area $S_2$ is greater than $S_1$.

2. The sole of claim 1 wherein said resilient material is impermeable to liquid.

3. The sole of claim 1 wherein said resilient material provides a wall for defining said at least one chamber containing liquid.

4. The sole of claim 1 wherein said at least one liquid containing chamber is comprised of material impermeable to liquid.

5. The sole of claim 1 wherein said resilient material has a cellular structure.

* * * * *

UNITED STATES PATENT AND TRADEMARK OFFICE

CERTIFICATE OF CORRECTION

PATENT NO. : 5,228,217

DATED : July 20, 1993

INVENTOR(S) : Leonid Y. Dabuzhsky

It is certified that error appears in the above-indentified patent and that said Letters Patent is hereby corrected as shown below:

Column 3, line 31, "FIG. 1BA" should read --FIG. 1B--.

Column 3, line 49, "FIG. 10E" should read --FIG. 1E--.

Column 3, line 53, "chamber; and" should read --chamber.--.

Column 5, line 35, "the liquid." should read --the liquid. If said area $S_2$ is larger than the surface area $S_1$ of the chamber ceiling which is in direct contact with the plantar surface of the foot, as shown in Fig. 2, then the sole provides the stress-dividing ability described above.--.

Signed and Sealed this

Second Day of August, 1994

Bruce Lehman

*Attest:*

BRUCE LEHMAN

*Attesting Officer*

*Commissioner of Patents and Trademarks*